US005386903A

United States Patent [19]

Rothschild et al.

[11] Patent Number: 5,386,903

[45] Date of Patent: Feb. 7, 1995

[54] COIN FILL AND DELIVERY SYSTEM FOR GAMING MACHINES

[75] Inventors: Wayne H. Rothschild, Wheeling; Gregory J. Tastad, Stone Park; Herbert H. Hausmann, Lincolnshire; Bradley T. Burke, Rockford, all of Ill.

[73] Assignee: WMS Gaming Inc., Chicago, Ill.

[21] Appl. No.: 123,538

[22] Filed: Sep. 17, 1993

[51] Int. Cl.[6] ..... G07F 1/04; G07F 9/06

[52] U.S. Cl. ..... 194/350; 194/351; 232/15; 232/43.2

[58] Field of Search ..... 194/206, 207, 344, 350, 194/351, 353; 453/16, 17, 57, 63; 273/143 R; 232/43.2, 64, 15; 193/DIG. 1; 206/0.81

[56] References Cited

U.S. PATENT DOCUMENTS

| | | | |
|---|---|---|---|
| 1,697,537 | 1/1929 | Mills | 273/143 R |
| 1,706,896 | 3/1929 | Mills | 273/143 R |
| 2,099,173 | 11/1937 | Norris | 273/143 R |
| 2,221,645 | 11/1940 | McMaster | 273/143 R X |
| 4,358,114 | 11/1982 | Burnside | 273/143 R |
| 4,638,746 | 1/1987 | Ishigure | 232/15 X |
| 4,949,901 | 8/1990 | Harris | 232/15 |
| 5,044,483 | 9/1991 | Stefan | 232/43.2 X |
| 5,046,989 | 9/1991 | Dass | 194/344 X |

FOREIGN PATENT DOCUMENTS

| | | | |
|---|---|---|---|
| 3303426 | 8/1984 | Germany | 194/350 |
| 2103281 | 2/1983 | United Kingdom | 232/43.2 |
| 2212314 | 7/1989 | United Kingdom | 194/350 |

*Primary Examiner*—Michael S. Huppert
*Assistant Examiner*—Scott L. Lowe
*Attorney, Agent, or Firm*—Rockey, Rifkin and Ryther

[57] ABSTRACT

The gaming machine consists of a cabinet supporting a game display and pay out trough. Located to one side of the game display is a dollar bill validator and stacker supported on a pivoting door such that when the door is opened the bill validator is pivoted out of the game cabinet to access a large coin receptacle. To resupply coins, the game operator simply opens the door and pours the coins into the top of the machine. Located below the receptacle is a coin hopper and escalator assembly for delivering coins from the hopper to the pay out trough. The coin hopper and escalator are mounted to one another and are supported on a sled removably supported on an inclined ramp. To service the coin escalator or hopper, the operator opens a door on the game cabinet and the sled supporting the coin hopper and escalator is rolled off of the ramp and out of the cabinet.

12 Claims, 4 Drawing Sheets

COIN FILL AND DELIVERY SYSTEM FOR GAMING MACHINES

BACKGROUND OF THE INVENTION

The invention relates, generally, to gaming machines and, more particularly, to a coin fill and delivery system for such machines.

Gaming machines typically consist of a cabinet supporting a video screen or a plurality of reels such as those commonly found on slot machines and plurality of player operated buttons. In the video games the video screen displays a game as directed by the game program associated with the computer control system. The player manipulates the buttons to control play of the game. It will be appreciated that the player operated buttons may preferably consist of "buttons" displayed on the video screen (touch screen control) although mechanical buttons located on the game cabinet can be used if desired.

While such machines can be used to play a wide variety of games, such as games with sports or fantasy themes, the use of these machines for gambling purposes, so called gaming machines, has risen dramatically in recent years. Such gaming machines are commonly found in casinos and legalized gambling locales where poker, blackjack, keno or other gambling games are permitted by law.

When used for gambling purposes, gaming machines are typically provided with a coin hopper for holding a quantity of coins or tokens. When the game player wins a game, the machine automatically pays out the player's winnings into a payout trough.

As will be appreciated, it is occasionally necessary to resupply the coin hopper. In existing gaming machines the resupply of coins is a cumbersome operation because of the design of the machines and the remote location of the coin hopper. Thus, it is desired to provide a gaming machine that can be easily and quickly resupplied with coins.

Moreover, existing gaming machines use relatively complex coin delivery mechanisms for delivering the coins from the hopper to the payout trough. These coin delivery mechanisms require occasional maintenance and repair where it is necessary to access the machines. Unfortunately in existing machine designs the coin delivery mechanisms are located in relatively inaccessible positions making maintenance and repair time consuming and difficult. Thus, a gaming machine having an easily accessible coin delivery mechanism is also desired.

SUMMARY OF THE INVENTION

The gaming machine of the invention consists of a cabinet supporting a video screen or a plurality of reels. Located to one side of the screen or reels is a dollar bill acceptor which is supported on a pivoting door such that when the door is opened the bill acceptor is pivoted out of the game cabinet to reveal a large coin receptacle. To resupply coins, the game operator simply opens the door and pours the coins into the top of the machine. Located below the coin receptacle is a coin hopper and escalator assembly for delivering coins from the hopper to the pay out trough. The coin hopper and escalator are mounted on a sled that is supported on wheels on an inclined cramp. To service the coin hopper and escalator assembly, the operator simply opens a door located on the front of the game cabinet and rolls the sled off of the ramp and out of the cabinet whereby repair and maintenance are greatly facilitated.

DETAILED DESCRIPTION OF THE INVENTION

Figure 1:
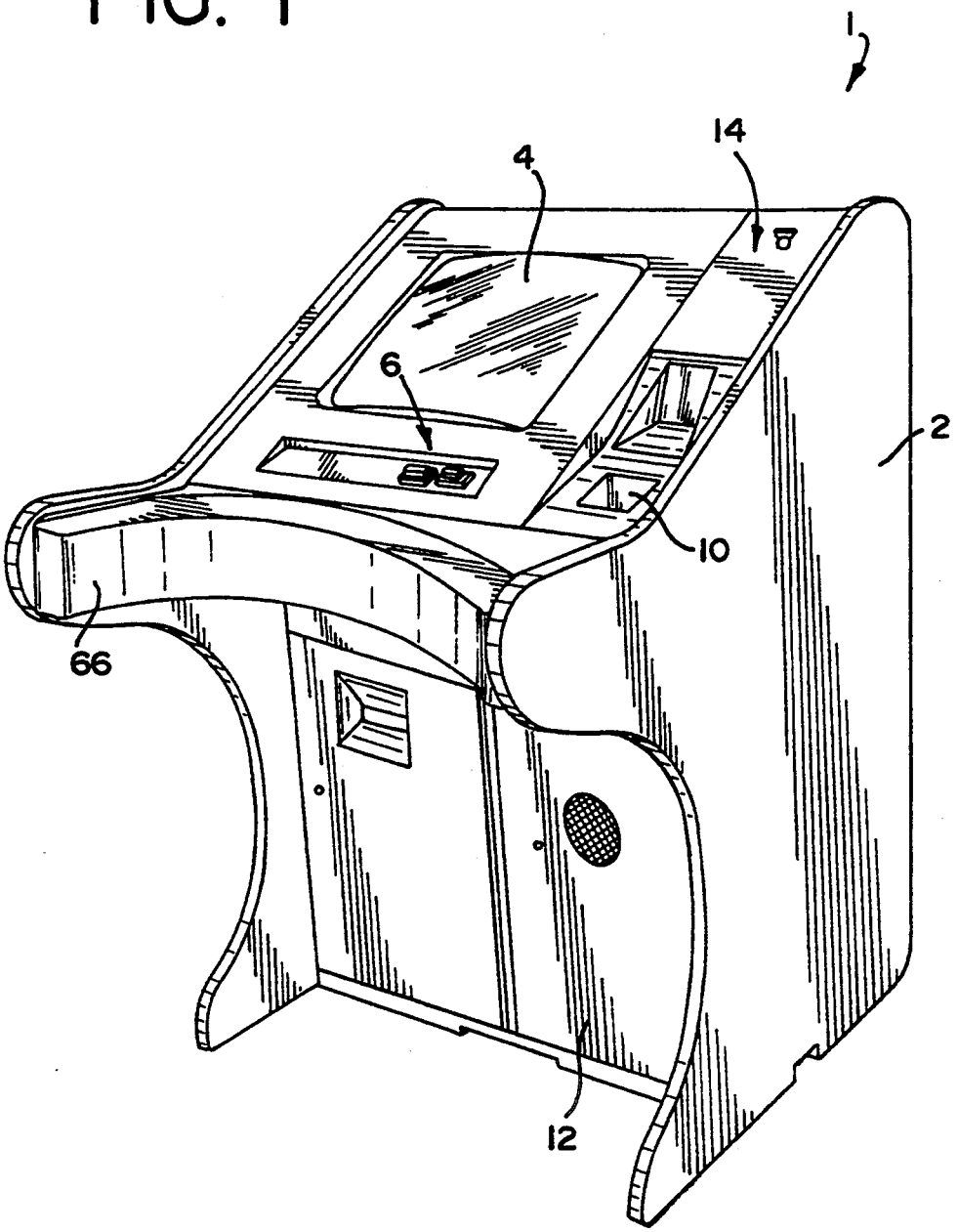
FIG. 1 is a perspective view of the gaming machine of the invention.

Referring more particularly to FIG. 1, the gaming machine of the invention is shown generally at 1 consisting of a cabinet 2 supporting a video screen 4 on which the video game is played. Alternatively the video screen can be replaced with a number of mechanical reels or the like for use as a slot machine. In any event the video screen or mechanical reels constitute the game display viewed by the game player. A plurality of switch buttons 6 can be located on the cabinet 2 that are manipulated by the player to control play of the game. The number and location of the buttons employed depends on the specifics of the game being played. Moreover, these mechanical buttons can be replaced by "buttons" displayed on the video screen 4 where a video game using touch screen control is employed.

The cabinet 2 further includes an access door 14 that supports a bill validator and stacker 8 as will be described in greater detail hereinafter. A pay out trough 10 is also provided where the player's winnings are delivered. Finally, located on the lower portion of the cabinet 2 is an access door 12.

Figure 2:
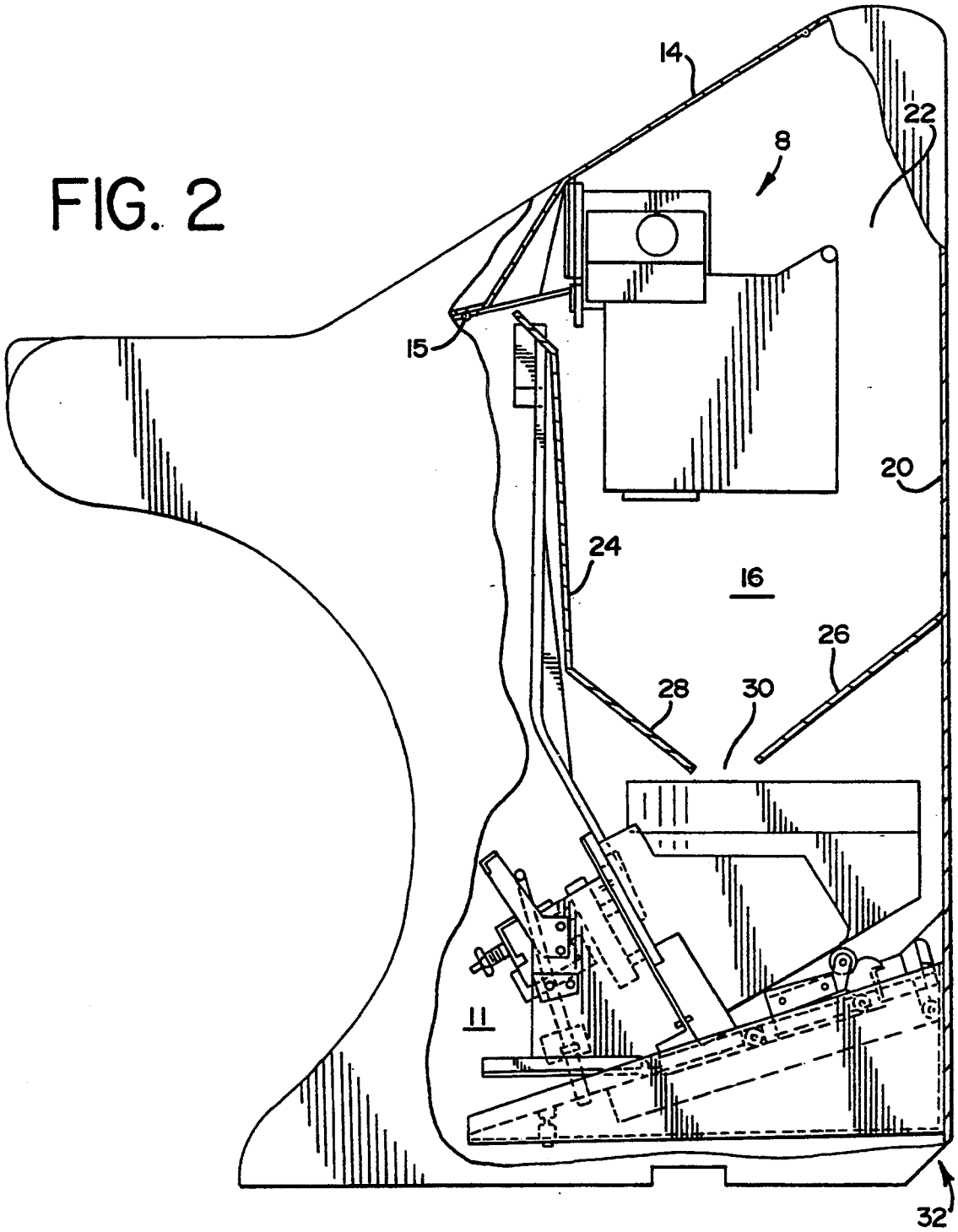
FIG. 2 is a partial cutaway side view of the gaming machine showing the internal structure of the invention.

Referring more specifically to FIG. 2, the game cabinet 2 is partially cut away to reveal the bill validator and stacker 8 and the interior cabinet space 11 accessed by door 12. The bill validator and stacker 8 is commercially available and the details thereof do not form a part of the invention. Preferred bill validators are manufactured by JCM, Inc. of Japan and Mars Electronics, Inc. of Pennsylvania.

Figure 3:
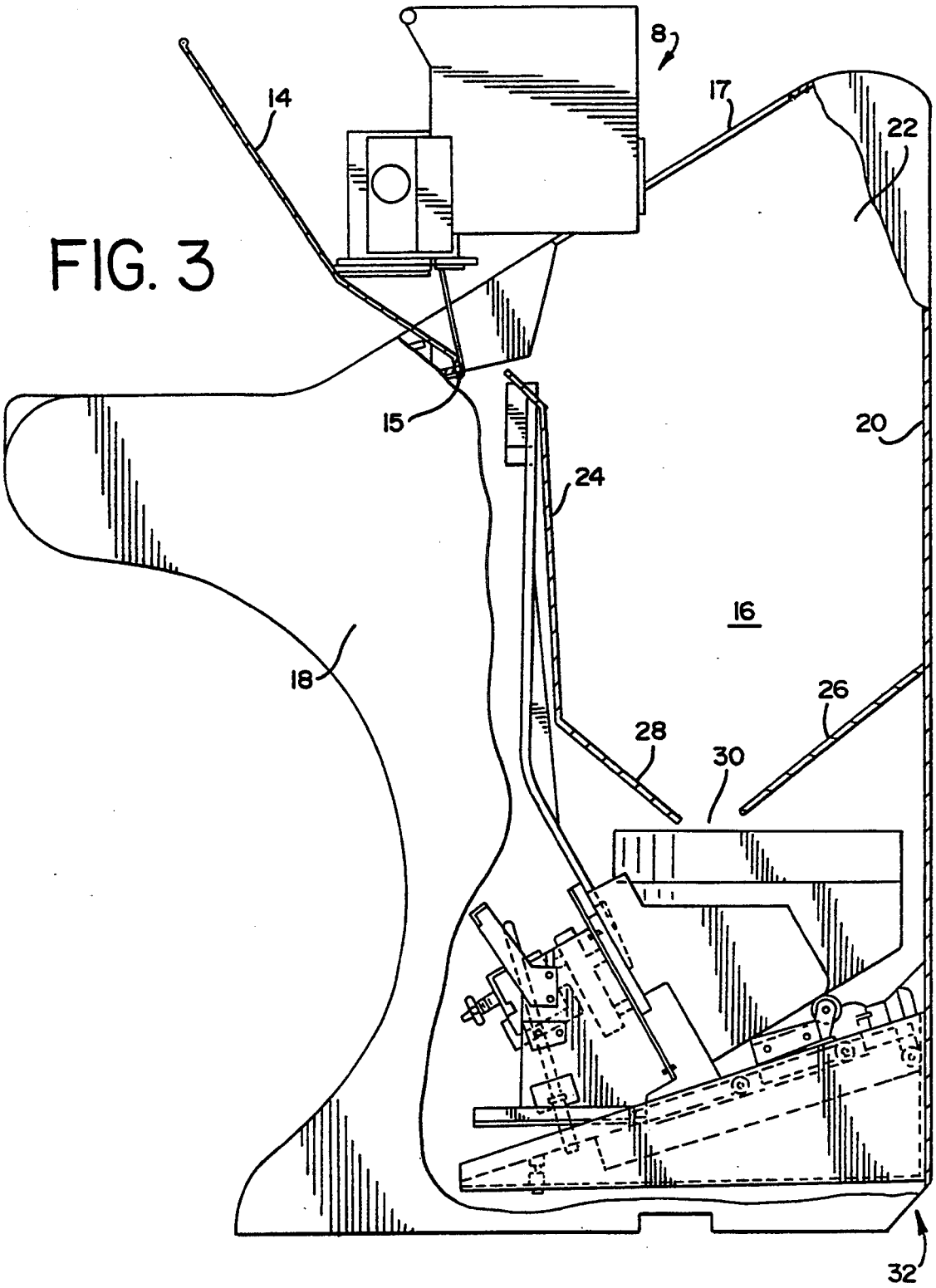
FIG. 3 is a partial cutaway side view similar to FIG. 2 showing the access door opened.

While the bill validator and stacker 8 itself does not form part of the invention, the manner of incorporation of the bill validator 8 into cabinet 2 does. Specifically, bill validator 8 is mounted to the underside of door 14 such that when door 14 is opened by pivoting it about axis 15, the bill validator is moved out of cabinet 2 through opening 17 to reveal an interior space 16 as best shown in FIG. 3. Interior space 16 is defined by the sidewall 18 and backwall 20 of cabinet 2, by internal wall 22 and by vertical baffle 24. Extending from back wall 20 and vertical baffle 24 are inclined baffles 26 and 28, respectively. The baffles 26 and 28 extend between walls 18 and 22 and the lower ends thereof are spaced from one another a short distance to create opening 30 such that the internal space 16 forms a large chute for receiving a supply of coins via opening 17. The chute delivers the coins by gravity to a coin hopper and escalator assembly 32 as will hereinafter be described.

From the foregoing description, it will be appreciated that the delivery of coins to the machine is very simple.

The game operator opens door 14 to access internal space 16 via opening 17. The coins are poured through the opening 17 into the chute and are delivered to the coin hopper via opening 30. After the coins are poured into space 16, the door 14 is closed and the game is ready for operation.

Figure 4:
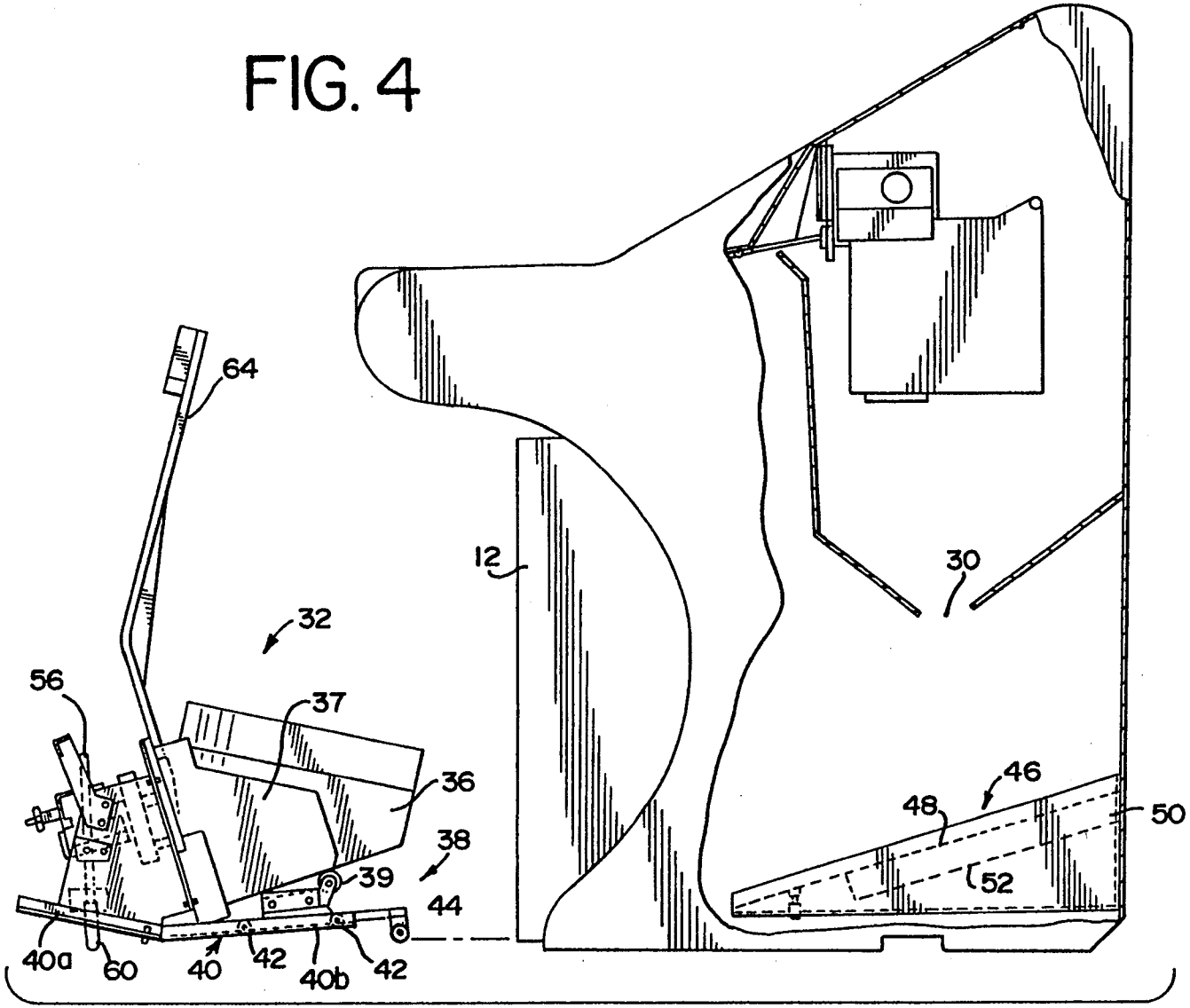
FIG. 4 is also a partial cutaway side view similar to FIG. 2 showing the coin hopper and escalator assembly removed.

The coin trough and escalator assembly 32 will now be described with specific reference to FIGS. 3, 4 and 5. The coin escalator 34 is commercially available and the details thereof do not form part of the invention. A suitable coin escalator is manufactured by Asahi Seiko, Corp. of Japan. The coin escalator delivers coins from coin hopper 36 to the payout trough 10 via delivery arm 64 when the player wins a game as will be appreciated by one skilled in the art.

Coin hopper 36 is open at the top to receive the coins delivered via space 30 and is removably secured to coin escalator 34 by bracket 37. The hopper is supported on a roller 39 that allows it to be easily removed from and inserted into bracket 37.

Both the coin escalator 34 and coin hopper 36 are supported on sled 38. Sled 38 includes a frame 40 supported on a plurality of rollers 42 arranged substantially flush thereto and a guide roller 44 centrally located on the sled and extending therefrom a short distance. As will be apparent from the figures, frame 40 has a first portion **40*a* and a second portion 40*b*** arranged at an angle relative to one another thereby to allow the front edge of the frame to clear the bottom of the cabinet when it is removed.

The rollers 42 slidably support sled 38 on a ramp 46 located on the bottom of the cabinet. The ramp has an inclined surface 48 on which rollers 42 ride. Moreover, a centrally located channel 50 having inclined surface 52 is provided on ramp 46 in which roller 44 rides. The engagement of rollers 44 with channel 50 insures that the coin hopper and escalator assembly is properly aligned in cabinet 2.

Figure 5:
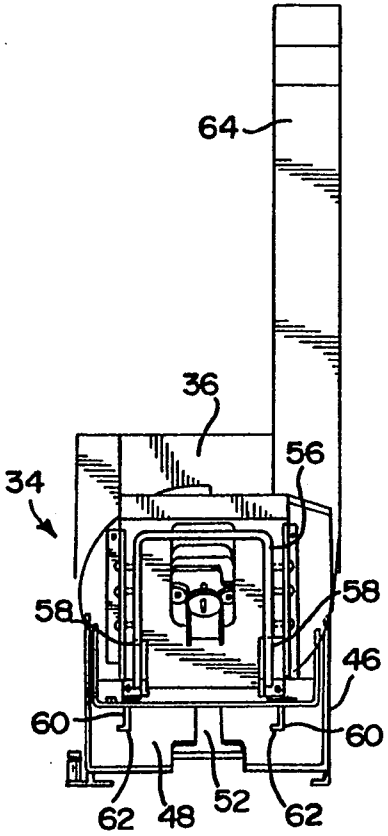
FIG. 5 is a front view of the coin hopper and escalator assembly on the supporting ramp.

To maintain coin escalator and trough 32 in position on ramp 46 a locking mechanism is provided that includes a U-shaped member 56 slidably supported in brackets 58 as best shown in FIG. 5. Each end of U-shaped member 56 support a pin 60 that extends through apertures 62 formed in ramp surface 48 to lock sled 38 on ramp 46. When member 56 is retracted, pins 60 will be removed from apertures 62 and sled 38 can be rolled off of ramp 46.

To remove the coin escalator and hopper assembly 32 from the cabinet, door 12 is opened and pins 60 are removed from engagement with ramp 46. The assembly 32 is then rolled out of cabinet 2 on rollers 42 and 44. Because the delivery arm 64 of coin escalator 34 extends to a position behind pay out trough 10, it is necessary to make trough 10 removable (shown in FIG. 1). Accordingly, trough 10 is removably supported in cabinet 10 by any suitable fastener such as mating brackets (not shown) that allow this element to be easily detached from the cabinet.

As will be appreciated, the design of the gaming machine of the invention greatly facilitates the operation, maintenance and repair of the machine. The lift out bill validator and top fill coin receptacle greatly increase the ease with which the machine can be refilled with coins because the opening is easily accessible and the coin receptacle is very large. Moreover, the removable coin hopper and escalator assembly greatly facilitates the repair and maintenance of this component by allowing full access thereto.

While the invention has been described in some detail with reference to the figures, it will be appreciated that numerous changes in the details and construction of the device can be made without departing from the spirit and scope of the invention.

What is claimed is:

1. A gaming machine, comprising:

a) a game cabinet supporting a game display and a payout receptacle;

b) a coin hopper located in said cabinet for storing a quantity of coins;

c) means for delivering coins from the hopper to the payout receptacle; and d) means for communicating the hopper with the exterior of the cabinet to allow the hopper to be filled with coins including an opening located in the cabinet and a chute connecting said opening with the hopper, said opening and said hopper being dimensioned to allow a quantity of coins to be poured therein, whereby the game operator can supply the hopper with a quantity of coins quickly and easily.

2. The gaming machine according to claim 1, further including a door for closing said opening, said door supports a bill validator, said bill validator being located in said chute when the door is closed and being removed from said chute when the door is opened.

3. The gaming machine according to claim 1, wherein said opening is located in the top of the cabinet.

4. The gaming machine according to claim 1, wherein the coins fall by gravity through the chute to said hopper.

5. The gaming machine according to claim 1, wherein said means for delivering includes a coin escalator.

6. The gaming machine according to claim 5, wherein said hopper and coin escalator are mounted on a movable sled.

7. The system according to claim 6, wherein said sled is removably supported on an inclined ramp.

8. The gaming machine according to claim 1, wherein said cabinet includes means for allowing removal of said hopper and said means for delivering.

9. The system according to claim 8, wherein said means for allowing removal includes a door located in said cabinet.

10. The system according to claim 8, wherein said means for allowing removal includes a removable payout receptacle.

11. A gaming machine comprising:

a ) a game cabinet;

b) a game display supported by said cabinet;

c) means for storing coins located inside said cabinet;

d) means for communicating the means for storing with the exterior of the cabinet to allow the means for storing to be supplied with coins comprising a door located in the cabinet and a chute connecting said door with the means for storing, said door supporting a bill validator, said bill validator being located in said chute when the door is closed and being removed from the chute when the door is opened.

12. A coin fill and delivery system for a gaming machine, comprising:

a) a game cabinet supporting a game display and a payout receptacle;

b) means for storing a quantity of coins located in said cabinet including a hopper;

c) means for delivering coins from said means for storing to said pay out receptacle including a coin escalator; and d) said hopper and said coin escalator being mounted on a movable sled that is removably supported in said cabinet.

* * * * *